US006170362B1

(12) United States Patent
Chen

(10) Patent No.: US 6,170,362 B1
(45) Date of Patent: Jan. 9, 2001

(54) SHOCK-PROOF STRUCTURE OF THE HANDLE COVER OF A HAND TOOL

(76) Inventor: John Chen, No. 14, Alley 6, Lane 17, Sec. 3, Chung Yang Rd., Lung Ching Hsiang, Taichung Hsien (TW)

( * ) Notice: Under 35 U.S.C. 154(b), the term of this patent shall be extended for 0 days.

(21) Appl. No.: 09/349,151

(22) Filed: Jul. 8, 1999

(51) Int. Cl.[7] ..... B25D 1/00
(52) U.S. Cl. ..... 81/22; 81/489
(58) Field of Search ..... 81/22, 177.1, 489, 81/490; 16/110 R, 111 R, DIG. 12, DIG. 18, DIG. 41; 76/103

(56) References Cited

U.S. PATENT DOCUMENTS

| | | | | |
|---|---|---|---|---|
| 2,603,260 | * | 7/1952 | Floren | 145/29 |
| 4,660,832 | * | 4/1987 | Shomo | 273/73 J |
| 5,280,739 | * | 1/1994 | Liou | 81/22 |
| 5,845,364 | * | 12/1998 | Chen | 16/111 R |
| 5,911,795 | * | 6/1999 | Tucker | 81/22 |
| 5,926,911 | * | 7/1999 | Chen | 16/111 R |

* cited by examiner

*Primary Examiner*—Timothy V. Eley
*Assistant Examiner*—Dung Van Nguyen
(74) *Attorney, Agent, or Firm*—Bacon & Thomas, PLLC

(57) ABSTRACT

A shock-proof structure of the handle cover of a hand tool for improving the shock-proof ability of the handle cover. Wherein the handle cover is made of soft elastic material and has a hollow handle shape. The center portion of the handle cover has an axial engaging hole for being engaged by an inserting portion of the hand tool. Characterized in that: banks of vents are formed at sides of the upper and lower portions of the handle cover, each vent has a certain depth within the handle cover without penetrating the handle cover. Thereby, the vents is formed as air bags in the upper and lower portions of the handle cover and as a shock-proof structure of the handle cover. Wherein when a react impact is induced from an object due to the hand tool, since user's hand holds the periphery of the vents, thus, the vents will be compressed and pinched so as to reduce the volume thereof. Meanwhile, the react impact from the hand tool is buffered. therefore, the impact from the hand tool to the hand of the user is reduced.

13 Claims, 7 Drawing Sheets

SHOCK-PROOF STRUCTURE OF THE HANDLE COVER OF A HAND TOOL

BACKGROUND OF THE INVENTION

1. Field of the Invention

The present invention relates to a shock-proof structure of the handle cover of a hand tool, and especially to a handle cover of a hand tool, when the handle cover is manufactured, shock-proof air bags are formed at proper places. By the shock-proof structure of the handle cover of a hand tool, a react impact will not apply directly to the hand of a user, moreover, the shock-proof structure of the handle cover of a hand tool of the present invention has a lower cost.

2. Description of the Prior Art

In the prior art hand tool, such as hammer, etc. the distal end of the handle tool is further encloses a soft elastic material (such as plastic or rubber). By the friction of the elastic material, the user may well hold the handle in order to prevent the sliding of the hand and buffer the impact as the handle tool is work.

However, since the prior art handle of a hand tool is solid, and the distal of the hand tool is enclosed tightly. Although a good touch sense is produced due to the soft elastic material, but it can not wholly absorb the react shock as the hand tool knock an object. In word words, the react impact from the hand tool directly transfers to the hand of the user, no effective shock absorption structure exists therebetween. The soft plastic material can not absorb all the impact to the handle.

Therefore, in a prior art design, an air bag is designed within the handle cover, and the inserting portion of a hand tool is installed in the center of the inserting portion. Thus, the air bag serves to absorb the react impact and the impact transferring to the user is thus induced. In fact, such a design has the effect of reducing impact force. However, such kind of air bag has a complicated structure, and is cost-consuming. Therefore, it is seldom used.

SUMMARY OF THE INVENTION

Accordingly, the object of the present invention is to provide a shock-proof structure of the handle cover of a hand tool for improving the shock-proof ability of the handle cover. Characterized in that: banks of vents are installed at sides of the upper and lower portions of said handle cover, and the vents is formed as air bags in the upper and lower portions of the handle cover and as a shock-proof structure of the handle cover. Wherein when a react impact is induced from an object due to the hand tool, since user's hand holds the periphery of the vents, thus, the vents will be compressed and pinched so as to reduce the volume thereof. Meanwhile, the reversing impact from said hand tool is buffered.

The present invention will be better understood and its numerous objects and advantages will become apparent to those skilled in the art by referencing to the following drawings in which:

DETAILED DESCRIPTION OF THE PREFERRED EMBODIMENT

Figure 1:
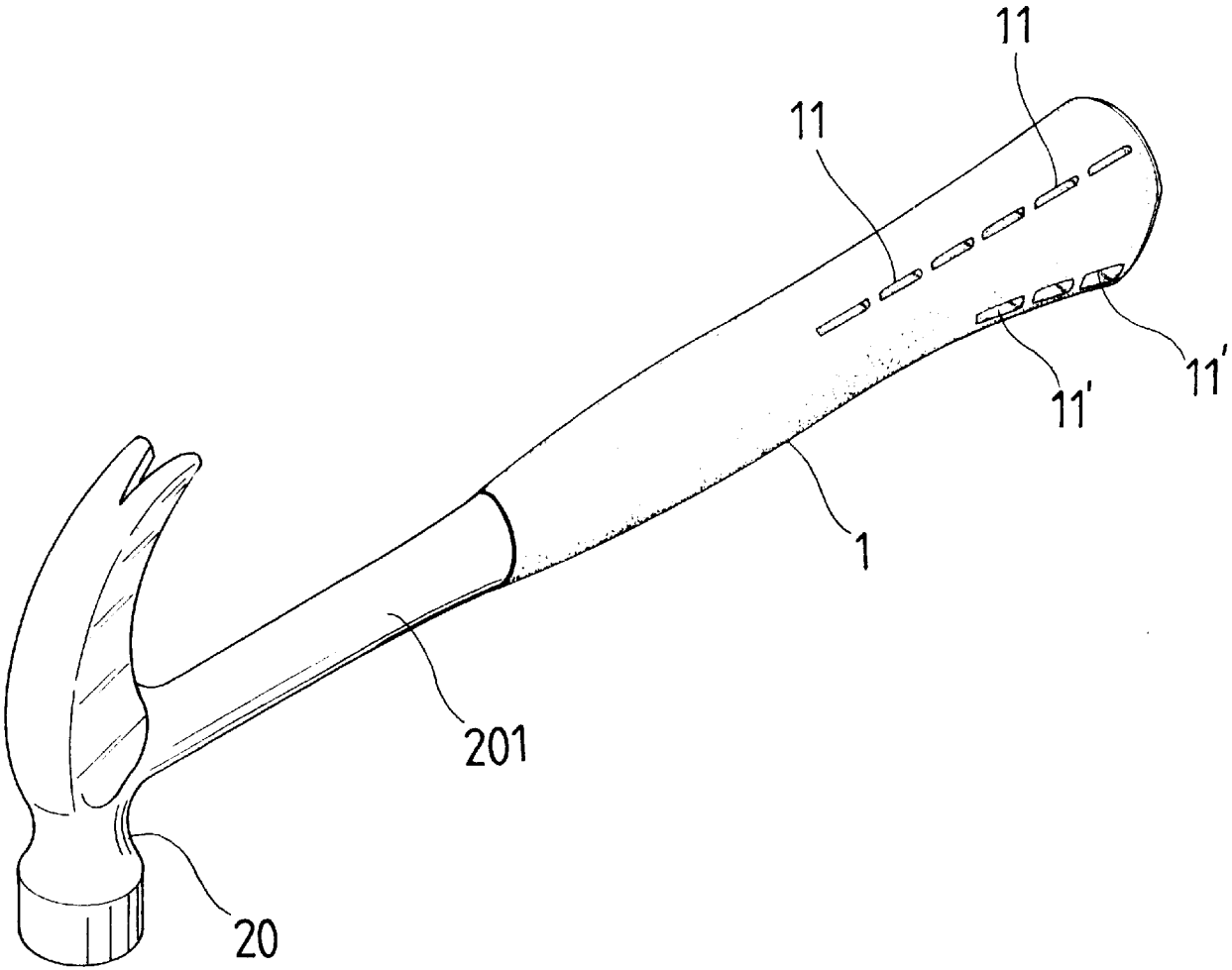
FIG. 1 is a schematic view showing the embodiment of the hammer in the present invention.

With reference to FIG. 1, the shock-proof structure of the handle cover of a hand tool in the present invention serve to improve the shock-proof ability of the handle cover 1. Thus the handle cover 1 covers the inserting portion 201 of a hammer 20. However, the present invention can be installed at any kinds of hand tools, in the following, an embodiment that the present invention employed in a hammer only serves as an example, but not to confine the use of the present invention defined in the appended claims. Those skilled in the art may modify and varied the embodiment within the scope and spirit of the present invention without depart from the definition of the claim.

Figure 3:
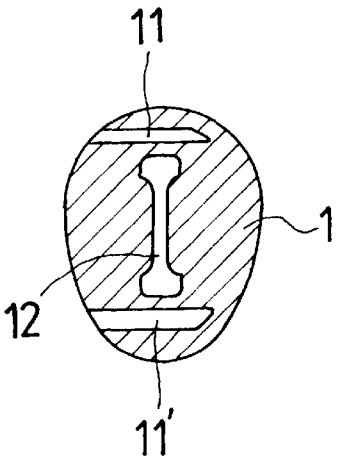
FIG. 3 is a schematic cross sectional view of the present invention.
Figure 2:
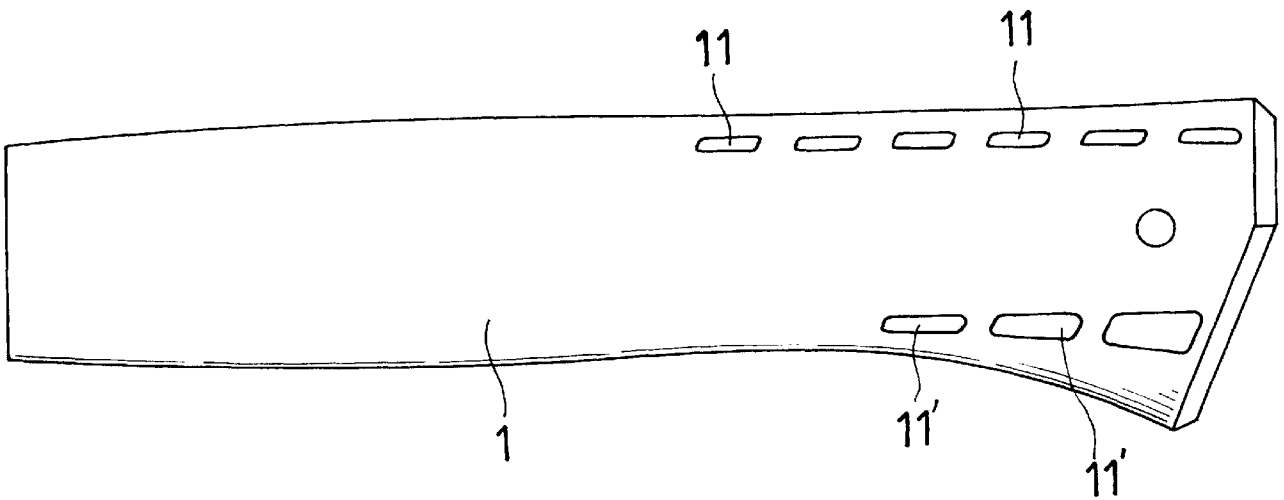
FIG. 2 is lateral view showing the handle cover of the present invention.

The handle cover 1 is made of soft elastic material (such as rubber or plastic) and has a hollow handle shape. A section of vents 11 and 11' (as shown in FIG. 2) are installed at sides of the upper and lower portions of the handle cover 1. Each vents 11 and 11' have a certain depth within the handle cover 1 without penetrating the handle cover 1 (as shown in FIG. 3). Thereby, the vents 11 and 11' forms as air bags in the upper and lower portion of the handle cover 1 and as a shock-proof structure of the handle cover. The center portion of the handle cover 1 has an axial engaging hole 12 for being engaged by the inserting portion 201 of the hammer 20 (as shown in FIGS. 1 and 3).

Figure 4:
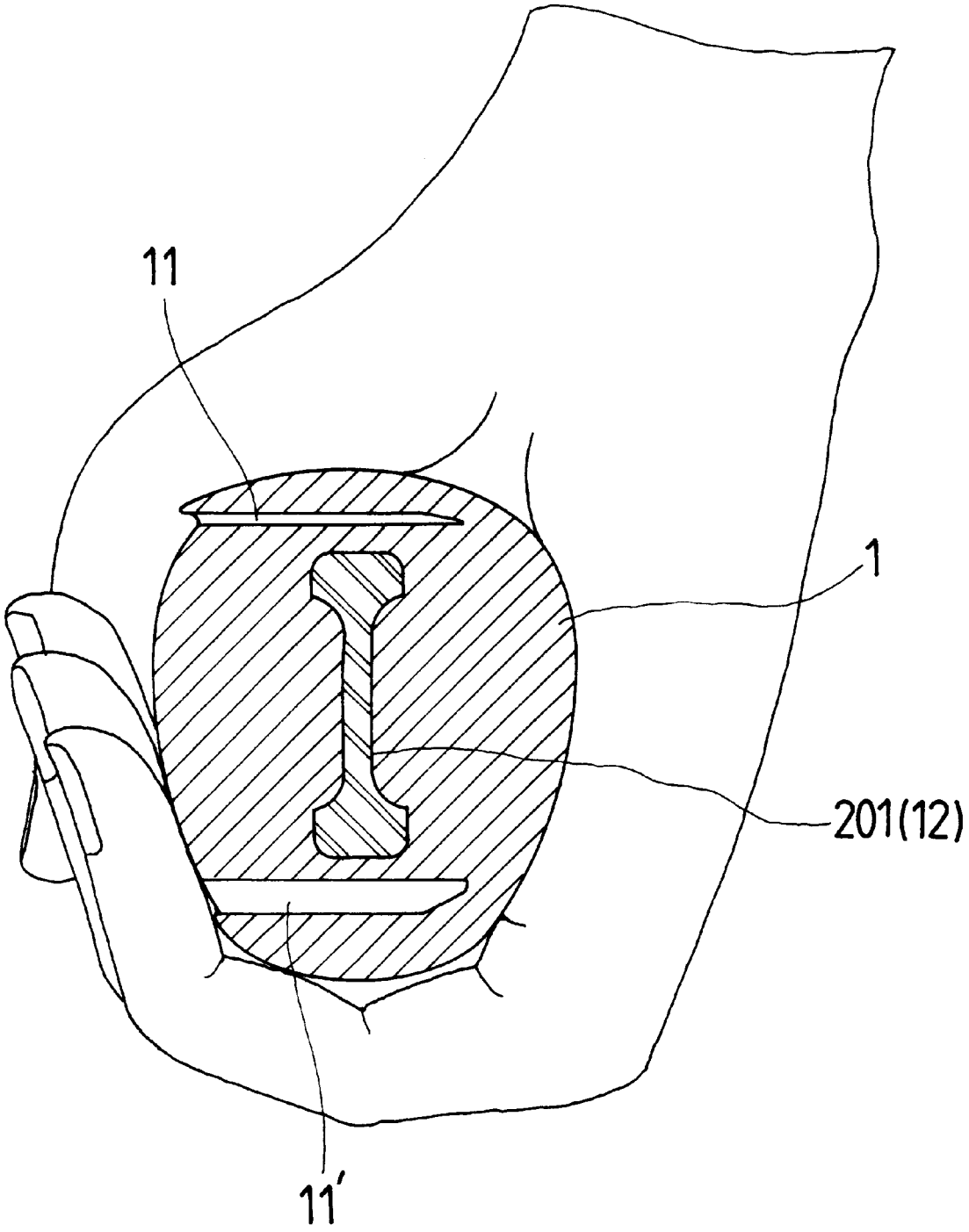
FIG. 4 is a schematic view showing the shock absorption of the handle cover in the present invention.
Figure 5:
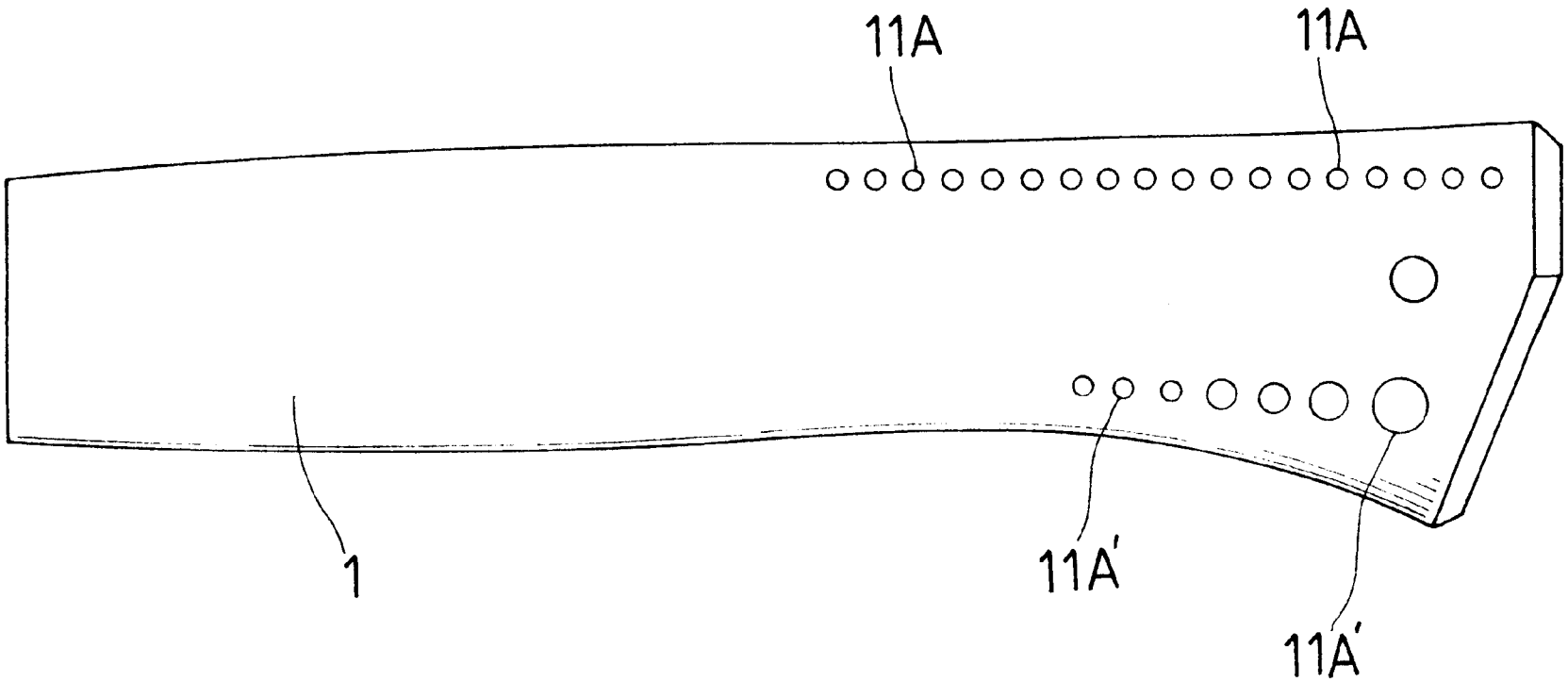
FIG. 5 is a schematic view showing round vents of the present invention.
Figure 6:
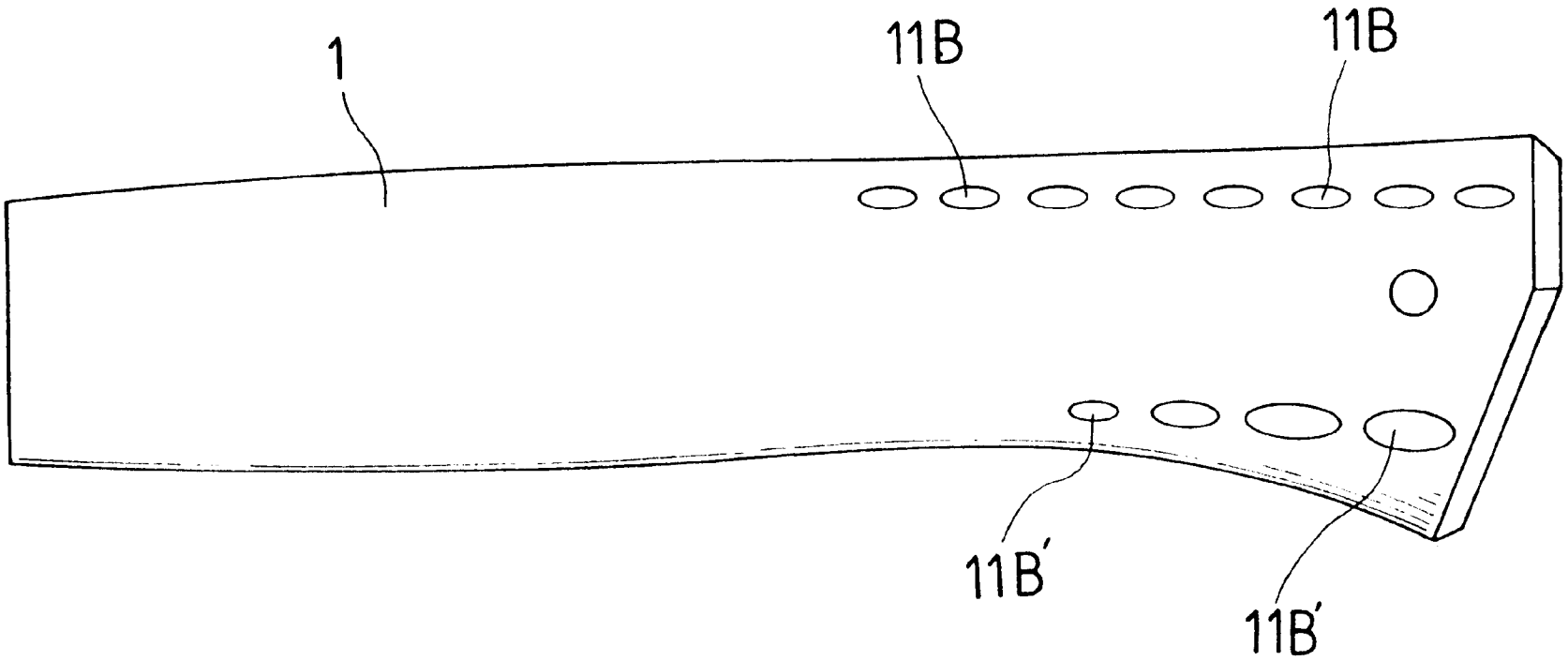
FIG. 6 is a schematic view showing oblong vents of the present invention.
Figure 7:
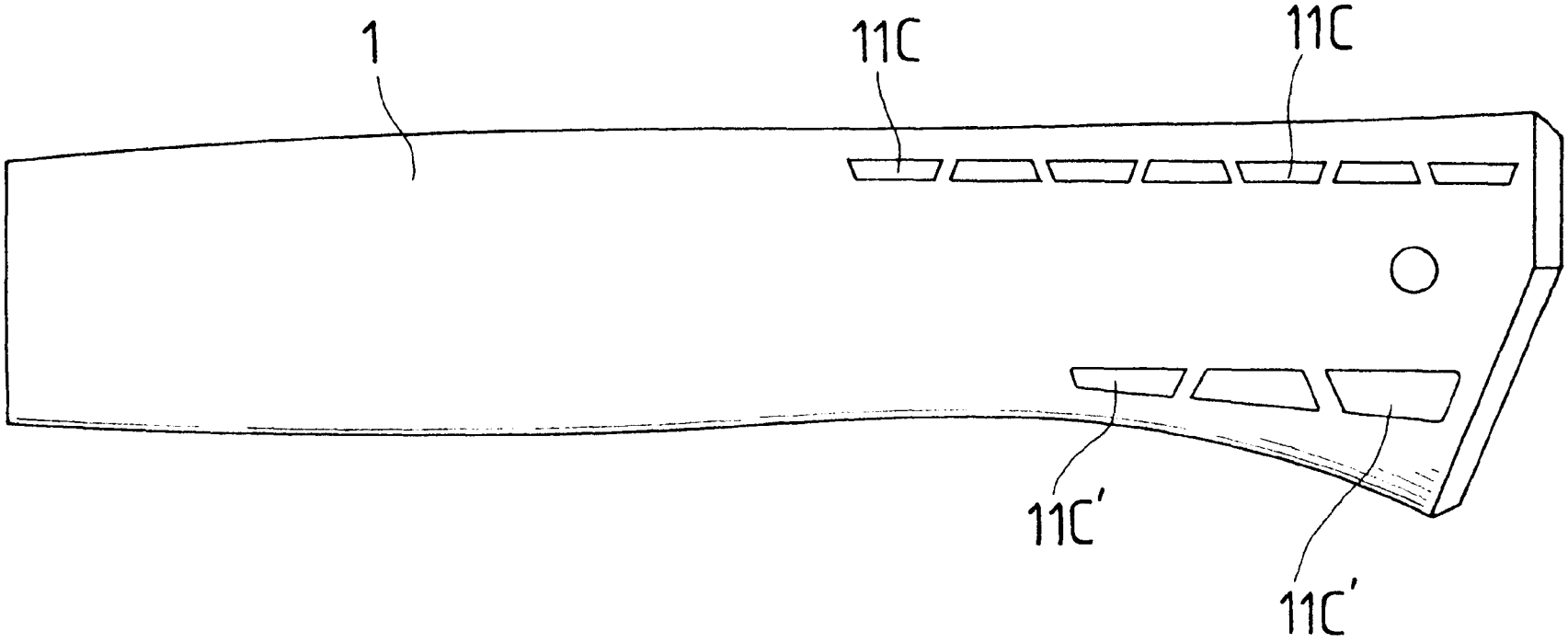
FIG. 7 is a schematic view showing trapezoidal vents of the present invention.
Figure 8:
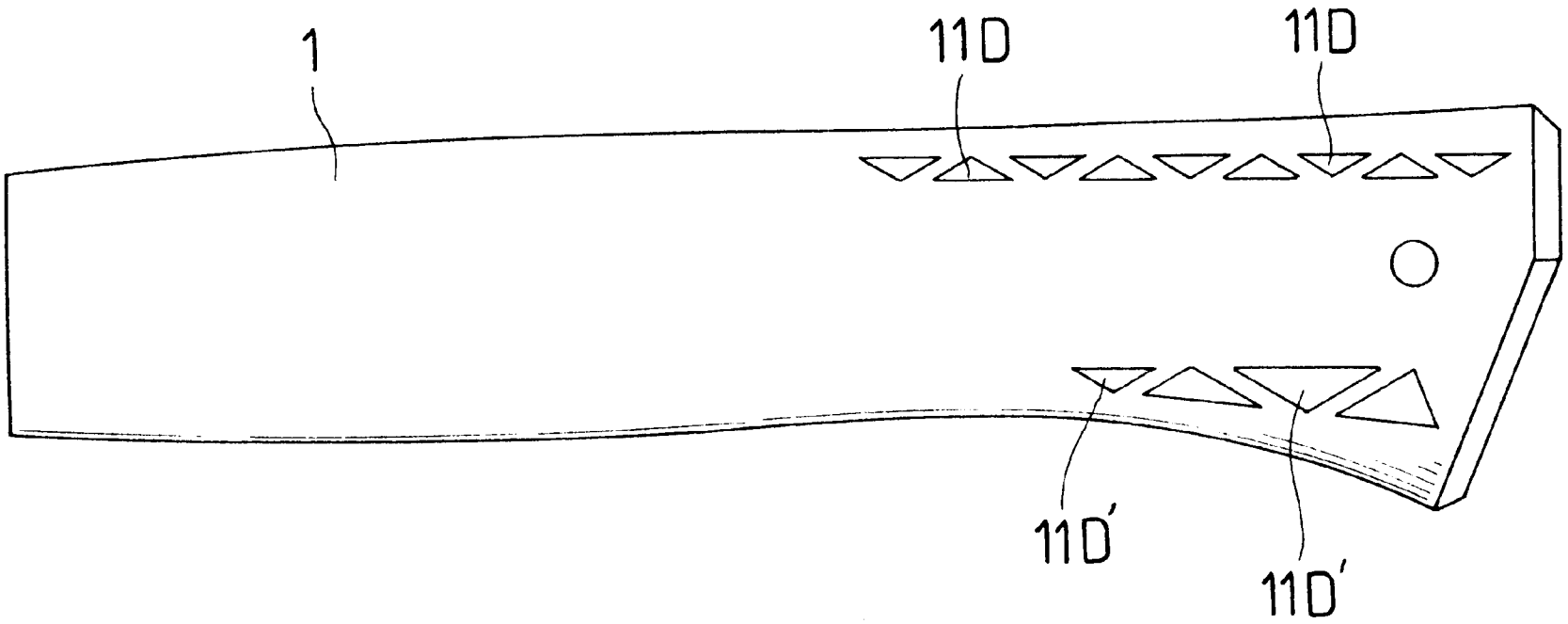
FIG. 8 is a schematic view showing polygonal vents of the present invention.

By installing the handle cover 1 with shock-proof vents 11 and 11' to the hammer 20. When user use the hammer 1, the user may hold the periphery of the handle cover 1 for knocking an object. When a react impact is induced from the object due to be knocked by the hammer, since the handle holds the periphery of the vents 11 and 11', thus, the vents 11 and 11' will be compressed and pinched so as to reduce the volume thereof (as shown in FIG. 4). Meanwhile, the reversing impact from the hammer is buffered. Therefore, the impact from the hammer to the hand of the user is reduced. Therefore, by the simple design of the vents 11 and 11', a preferred shock-proof ability is achieved. Since the handle cover 1 is made concurrently with the vents 11 and 11', when the hammer 20 is installed, it is unnecessary to be further installed with air bags as that in the prior art. Thus, the finishing cost is also reduced.

Moreover, the shape of the vents 11 and 11' are not confined by above example, for example, the vent may have a round shape 11A and 11A', an oblong shape 11B and 11B', an trapezoid shape 11C and 11C', a polygonal shape 11D and 11D' (as shown in FIGS. 5~8), all these design have the effect of absorbing impact force.

Although the present invention has been described using specified embodiment, the examples are meant to be illustrative and not restrictive. It is clear that many other variations would be possible without departing from the basic approach, demonstrated in the present invention.

What is claimed is:

1. A shock-proof structure of a handle cover of a hand tool for improving the shock-proof ability of said handle cover, wherein said handle cover is made of soft elastic material and has a hollow handle shape; the center portion of said handle cover has an axial engaging hole for being engaged by an inserting portion of said hand tool; characterized in that:

banks of vents are installed at sides of the upper and lower portions of said handle cover, each vent has a certain depth within said handle cover extending past a longitudinal axis of the engaging hole without passing through the handle cover, thereby, the vents are formed as air bags in the upper and lower portions of the handle cover and as a shock-proof structure of the handle cover; wherein when a react impact is induced from an object due to the hand tool, since a user's hand holds the vent openings, thus, the vents will be compressed and pinched so as to reduce a volume thereof, meanwhile, the react impact from said hand tool is buffered and the impact from said hand tool to said hand of said user is reduced.

2. The shock-proof structure of the handle cover of a hand tool as claimed in claim 1, wherein the hand tool is a hammer, the inserting portion of said hammer is fixedly installed within said engaging hole of said handle cover.

3. The shock-proof structure of the handle cover of a hand tool as claimed in claim 1, wherein the cross section of said vent of said handle cover has a round shape.

4. The shock-proof structure of the handle cover of a hand tool as claimed in claim 1, wherein the cross section of said vent of said handle cover has an oblong shape.

5. The shock-proof structure of the handle cover of a hand tool as claimed in claim 1, wherein the cross section of said vent of said handle has an trapezoidal shape.

6. The shock-proof structure of the handle cover of a hand tool as claimed in claim 1, wherein the cross section of said vent of said handle cover has a polygonal shape.

7. The shock-proof structure of the handle cover of a hand tool as claimed in claim 1, wherein each vent has a longitudinal axis arranged substantially orthogonal to, but not coplanar with, the longitudinal axis of the engaging hole.

8. A cover for a tool handle having a longitudinal axis, comprising:

a soft elastic body surrounding at least a portion of the handle;

a plurality of holes arranged substantially parallel to each other in the body;

each of said holes also arranged substantially orthogonal to, but not coplanar with, the longitudinal axis of the handle; and wherein each of the holes extends only partially through the body and past the longitudinal axis of the handle.

9. The cover recited in claim 8 wherein at least two of said holes are coplanar with each other.

10. The cover recited in claim 9 wherein said at least two holes are arranged on the same side of the longitudinal axis of the handle.

11. The cover recited in claim 9 wherein said at least two holes are arranged on opposite sides of the longitudinal axis of the handle.

12. The cover recited in claim 11 wherein said opposite sides correspond to front and back sides of the tool.

13. The cover recited in claim 12 wherein a shape of the holes is selected from the group consisting of round, oblong, trapezoidal, and polygonal.

* * * * *